United States Patent [19]

Eller

[11] Patent Number: 4,680,017

[45] Date of Patent: Jul. 14, 1987

[54] MOTORBOAT PROPELLER GUARD FOR IMPROVED PERFORMANCE

[76] Inventor: Dennis E. Eller, 814 N. Wooster, Algona, Iowa 50511

[21] Appl. No.: 838,161

[22] Filed: Mar. 10, 1986

[51] Int. Cl.[4] ..... B63H 5/16

[52] U.S. Cl. ..... 440/66; 440/71; 440/72

[58] Field of Search ..... 440/66, 67, 72, 71

[56] References Cited

U.S. PATENT DOCUMENTS

| | | | |
|---|---|---|---|
| 389,330 | 9/1888 | Smith | 440/67 |
| 2,963,000 | 12/1960 | Fester | 440/71 |
| 2,983,246 | 5/1961 | Manley | 440/72 |
| 3,035,538 | 5/1962 | Willard | 440/72 |
| 4,070,984 | 1/1978 | Kappas | 440/72 |
| 4,565,533 | 1/1986 | Springer | 440/71 |

*Primary Examiner*—Jeffrey V. Nase
*Assistant Examiner*—Edwin L. Swinehart
*Attorney, Agent, or Firm*—Zarley, McKee, Thomte, Voorhees & Sease

[57] ABSTRACT

A propeller guard includes a rigid U-shaped sleeve which has a pair of legs extending on either side of the lower housing in the motor. The cavitation plates on the lower housing are received within a U-shaped channel formed in the sleeve for mounting the guard upon the motor. A cylindrical shield having an open inlet end and an open outlet end is secured to the sleeve and encircles the propeller to protect the propeller from contact with foreign objects. A frame member extends downwardly from the forward edge of the sleeve to the lower portion of the inlet end of the shield and engages the leading edge of the lower housing to provide structural support for the guard. A plurality of horizontally disposed ribs extend from the frame member to the shield to further protect the propeller from contact with foreign objects. A gridwork is pivotally mounted over the open outlet end of the shield to further protect the propeller from contact with foreign objects. The shield is positioned such that the longitudinal axis thereof is co-extensive with the axis of rotation of the propeller. The inlet end of the shield is coplanar with the forward end of the propeller and the inlet end of the shield extends rearwardly beyond the rearward end of the propeller.

13 Claims, 6 Drawing Figures

MOTORBOAT PROPELLER GUARD FOR IMPROVED PERFORMANCE

BACKGROUND OF THE INVENTION

The propeller of a motorboat typically dwells at an elevation below the bottom of the boat. Accordingly, it is not unusual for the propeller to become damaged by contact with objects on the bottom of the body of water when the boat is operated in shallow water. Such damage to the propeller decreases the performance of the boat. Repairing or replacing the propeller is costly. Accoringly, it is desirable to protect the propeller from such damage.

Furthermore, water skiers and other swimmers have been accidentally injured by boat propellers which are unprotected. Therefore, it is desirable to provide a propeller guard as a personal safety feature.

Also, it is understood that a boat moves forward in response to the water forced rearwardly by the propeller. This movement is in accordance with the basic physics principle that for every action there is an equal and opposite reaction. However, in the operation of motorboats, some of the water which is acted upon by the propeller is forced radially outwardly rather than linearly rearwardly. The force of the radially dissipating water does not contribute to the forward motion of the boat and is therefore wasted. Accordingly, it is desirable to eliminate such radial dissipation of water and direct all water acted upon by the propeller in a linearly rearward direction.

Therefore, a primary objective of the present invention is the provision of a motorboat propeller guard which protects the propeller from damage and which improves the performance of the motorboat.

Another objective of the present invention is the provision of a performance guard which can be quickly and easily attached to the propeller unit.

These and other objectives will become apparent from the following description of the present invention.

SUMMARY OF THE INVENTION

The motorboat generally includes a motor, a propeller, drive means for drivingly interconnecting the propeller with said motor, and a lower housing for enclosing the drive means. The lower housing has a leading edge and a trailing edge, and terminates in a vertically disposed skeg. A pair of horizontally disposed cavitation plates extend laterally from the lower unit above the propeller.

The guard of the present invention includes a rigid U-shaped cage with opposite rearwardly extending legs. An elongated U-shaped channel is formed in the sleeve so as to have a closed forward end and open rearward ends.

A cylindrical propeller shield extends downwardly from the sleeve and encircles the propeller so as to protect the propeller from contact with foreign objects. A plurality of concentrically positioned arcuately shaped rings form a gridwork which is releasably mounted over the open outlet end of the shield to further protect the propeller from contact with foreign objects. A channel-shaped frame member extends between the forward end of the sleeve and the lowermost portion of the open inlet end of the shield. This frame member engages the leading edge of the lower housing substantially along its length. A plurality of horizontally disposed ribs extend between the frame member and the shield to further protect the propeller from contact with foreign objects.

The guard is mounted on the motorboat by first removing or pivoting the rear gridwork out of its normal outlet covering position. Then, the entire guard is slid rearwardly into place with the cavitation plates being received within the channel of the sleeve until the forward frame member engages the leading edge of the lower housing. Thus, the guard is supported by the cavitation plates. A latch is then closed and secured at the rearward end of the sleeve legs so as to prevent forward movement of the guard with respect to the propeller unit.

When the guard is in position, the longitudinal axis of the shield is co-extensive with the axis of rotation of the propeller. Also, the open inlet end of the shield is coplanar with the forward edge of the propeller and the open rearward end of the shield extends rearwardly beyond the rearward end of the propeller. Accordingly, the open inlet end of the shield allows an unrestricted flow of water to the propeller. The water is acted upon by the propeller and is ejected linearly rearwardly from the open outlet end of the shield without radial dissipation of the acted upon water, so as to propel the boat forwardly with increased acceleration and velocity.

DETAILED DESCRIPTION OF THE DRAWINGS

Figure 1:
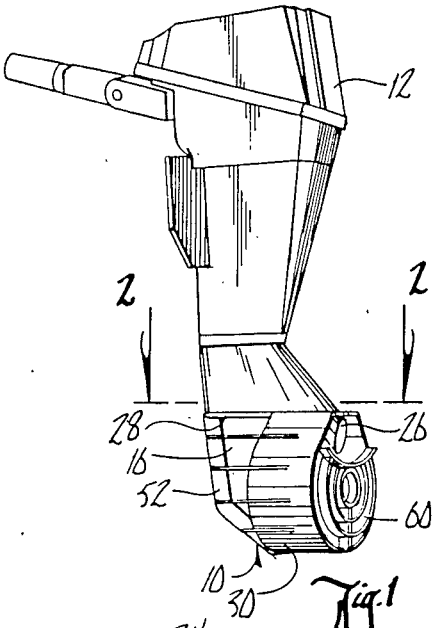
FIG. 1 is a perspective view of an outboard motor having the guard of the present invention mounted thereon.
Figure 2:
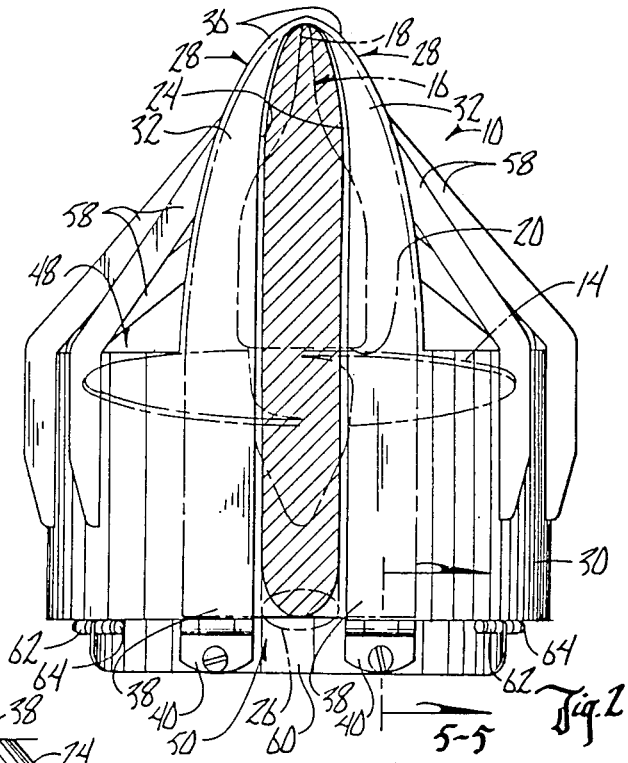
FIG. 2 is a sectional plan view taken along lines 2—2 of FIG. 1.
Figure 3:
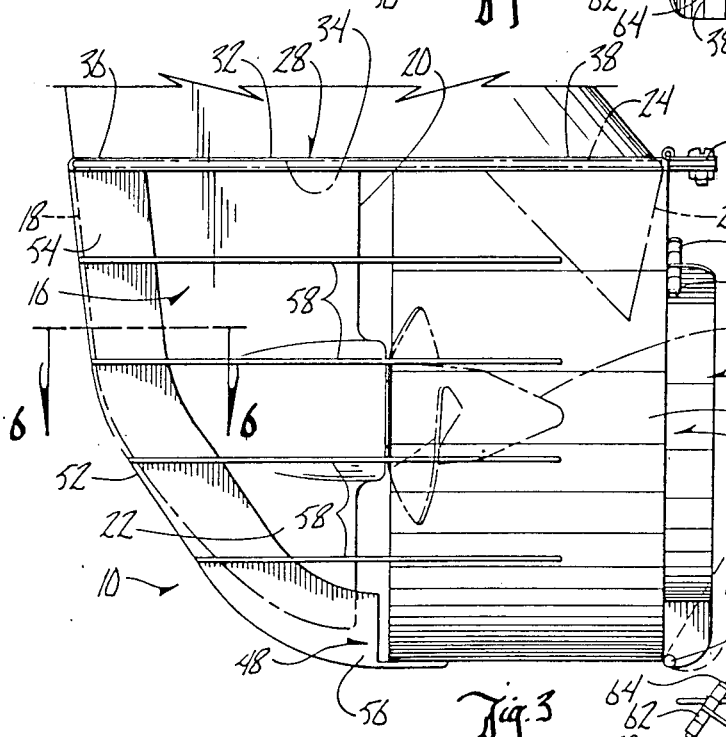
FIG. 3 is a partial side view of the guard of the present invention in position on a propeller unit.
Figure 5:
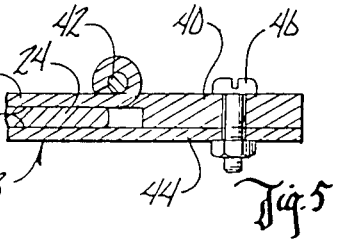
FIG. 5 is a sectional view taken along lines 5—5 of FIG. 2.
Figure 6:
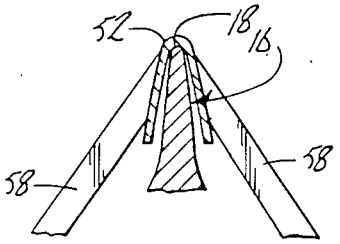
FIG. 6 is a sectional view taken along lines 6—6 of FIG. 3.

The performance guard of the present invention is generally designated in the drawings by the reference numeral 10. Guard 10 is adapted for use on motorboats having either an outboard motor 12, as shown in FIG. 1, or an inboard-outboard motor (not shown). A propeller 14 is operatively connected to motor 12 by conventional drive means (not shown). A lower housing 16 encloses the drive means and includes a leading edge 18 and a trailing edge 20. The lower housing terminates in a skeg 22. A pair of horizontally disposed cavitation plates 24 prevent air from being sucked downwardly by the rotation of the propeller. An exhaust pipe 26 is provided for venting of motor 12.

The above description of the outboard motor is conventional and does not constitute a part of the present invention.

Guard 10 of the present invention basically includes a mounting sleeve 28 and a cylindrical shield 30. Mounting shield 28 is generally U-shaped and includes a pair of rearwardly extending legs 32. A U-shaped channel is formed within sleeve 28. Channel 34 has a closed forward end 36 and open rearward ends 38.

Sleeve 28 is adapted to slide rearwardly around lower housing 16 such that one leg 32 is on either side thereof and such that cavitation plates 24 are received within channel 34. The forward end of the cavitation plates engages the closed forward end of channel 34, so as to prevent further rearward movement of sleeve 28. A latch 40 is pivotally connected to the rearward end of each leg 32 by hinge pin 42, and is locked to an extension 44 of leg 32 by nut and bolt assembly 46 or the like. Thus, latches 40 close the open rearward ends 38 of channel 34 so as to substantially prevent forward movement of sleeve 28 with respect to motor 12.

Shield 30 is secured to sleeve 28 by welding or the like. Shield 30 has an open inlet end 48 and an open outlet end 50. When sleeve 28 is in position on cavitation plates 24, the longitudinal axis of shield 30 is coextensive with the axis of rotation of propeller 14. Also, when guard 10 is in place, the plane defined by inlet end 48 is coplanar with the plane defined by the forward edge of the propeller blades. The plane defined by outlet end 50 is positioned rearwardly of the plane defined by the rearward edge of the propeller blades.

This positioning of shield 30 with respect to propeller 14 enhances the performance of the motorboat. More particularly, the open inlet end 48 of shield 30 allows an unrestricted feed of water to the propeller. The water which is acted upon by the propeller is ejected linearly rearwardly from the open outlet end of the shield without any radial dissipation of the water, as would result in the absence of shield 30. Thus, a greater quantity of water is forced rearwardly such that the boat reacts by moving forwardly with greater acceleration and velocity. The wasted force of radially dissipating water which is normally present in the absence of shield 30 is therefore converted to a useful propelling force by shield 30.

Guard 10 also includes a forward frame member 52 which has an upper end 54 which is secured to the forward portion of sleeve 28 and a lower end 56 which is secured to the lower portion of the inlet end of shield 30. Frame member 52 is channel-shaped so as to extend around leading edge 18 of lower housing 16, and engages the leading edge along its substantial length. Thus, frame member 52 provides structural support for guard 10 and protects leading edge 18 and skeg 22 from damage caused by contact with foreign objects.

A plurality of horizontally disposed ribs 58 extend between frame member 52 and shield 30 on either side of lower housing 16 so as to further protect propeller 14 from contact with foreign objects. Ribs 58 are shown to be substantially flat straps, however, other construction is possible, such as round bars.

Figure 4:
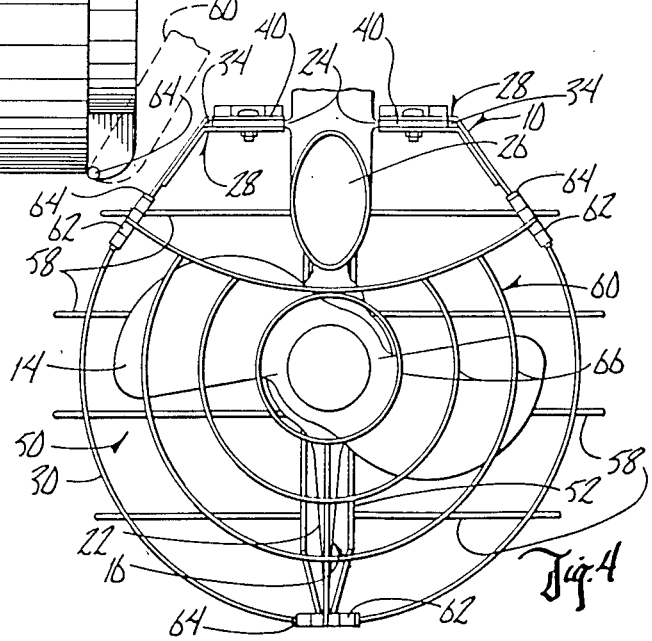
FIG. 4 is a partial rearward view of the guard in position on a propeller unit.

The open outlet end 50 of shield 30 is normally closed by a gridwork 60, as best shown in FIG. 4. Gridwork 60 is pivotally secured to shield 30 by a hinge 52 and a plurality of removable pins 64. Accordingly, by removing the appropriate pin 64, gridwork 60 can be pivoted out of its normal position over outlet end 50 of shield 30 so that guard 10 can be quickly and easily mounted and removed from motor 12.

Preferably, gridwork 60 is comprised of a plurality of concentrically positioned circular or arcuately shaped rings 66. Other gridwork patterns are also feasible, such as criss-crossed bars. Gridwork 60 further prevents propeller 14 from contacting foreign objects, particularly when the propeller is operated in the reverse direction to move the boat rearwardly. Also, gridwork 60 protects skiers and other swimmers from being accidentally hit by the propeller.

From the foregoing, it is seen that at least all of the stated objectives are accomplished by the performance guard of the present invention.

What is claimed is:

1. In combination with a motorboat including a motor, a propeller operatively connected to said motor, a lower housing with opposite leading and trailing edges and terminating in a vertically disposed skeg, said propeller being mounted on said lower housing adjacent said trailing edge and above said skeg, and a pair of horizontally disposed cavitation plates having forward and rearward ends extending laterally from said lower housing and above said propeller, a propeller guard comprising:

a rigid U-shaped sleeve having a forward end and opposite rearwardly extending legs and an elongated U-shaped channel formed therin, said channel having a closed forward end and open rearward ends which extend at least to the rearward ends of said cavitation plates, said open rear ends of said channels having an effective width therebetween substantially equal to the maximum combined width of said pair of cavitation plates whereby said sleeve is adapted to slide rearwardly into position with said legs extending on each side of said lower housing and with said cavitation plates received within said channel until said forward end of said sleeve engages said leading edge of said lower housing to thereby prevent rearward movement of said guard;

means for closing said open rearward ends of said channel and thereby prevent forward movement of said sleeve; and a propeller shield having open inlet and outlet ends, being attached to said sleeve for encircling said propeller and thereby protecting said propeller from contact with foreign objects, a frame member extending downwardly from the forward end of said sleeve and engaging said leading edge of said lower housing substantially along the length thereof, and a plurality of longitudinally disposed ribs extending between said frame member and said shield to further protect said propeller from contact with foreign objects.

2. The guard of claim 1 wherein said ribs are flat straps each having a primary surface disposed in a horizontal plane.

3. The guard of claim 1 wherein said frame member is channel-shaped in cross-section so as to extend around the leading edge of said lower housing.

4. The guard of claim 1 wherein said means for closing said rearward ends of said channel include a latch pivotal about a horizontal axis connected to said sleeve and fastening means releasably extending through said latch and said sleeve to secure said latch to said sleeve.

5. The structure of claim 4 wherein each of said rearwardly extending legs includes a latch hinged about a horizontal axis leaving an open space between said legs for said lower housing and cavitation plate to pass.

6. The guard of claim 1 further comprising a gridwork releasably mounted over said outlet end of said shield to further protect said propeller from contact with foreign objects.

7. The guard of claim 6 wherein said gridwork includes a plurality of concentrically positioned arcuately shaped rings.

8. The guard of claim 6 further further including hinge means for pivotally connecting said gridwork to said shield, said hinge positioned at the bottom of said shield and gridwork for pivoting said gridwork from a closed upstanding vertical position, rearwardly and downwardly.

9. The guard of claim 1 wherein said propeller has an axis of rotation and opposite forward and rearward ends, said shield being substantially cylindrical and having a diameter slightly greater than that of said propeller, and said shield being secured in position around said propeller such that said longitudinal axis of said shield is coextensive with the axis of rotation of said propeller, and such that the inlet end of said shield is coplanar with the forward end of said propeller and the outlet end of said shield extends rearwardly beyond the rearward end of said propeller, whereby the open inlet end of said shield allows an unrestricted flow of water to said propeller, and whereby the water is acted upon by said propeller and is ejected linearly rearwardly from the open outlet end of said shield without radial dissipation so as to move the motorboat forwardly with increased acceleration and velocity.

10. In combination with a motorboat including a motor, a propeller operatively connected to said motor, a lower housing with opposite leading and trailing edges and terminating in a vertically disposed skeg, said propeller being mounted on said lower housing adjacent said trailing edge and above said skeg, and a pair of horizontally disposed cavitation plates having forward and rearward ends extending laterally from said lower housing and above said propeller, a propeller guard comprising:

a rigid U-shaped sleeve having a forward end and opposite rearwardly extending legs and an elongated U-shaped channel formed therein, said channel having a closed forward end and open rearward ends which extend at least to the rearward ends of said cavitation plates, said open rear ends of said channels having an effective width therebetween substantially equal to the maximum combined width of said pair of cavitation plates whereby said sleeve is adapted to slide rearwardly into position with said legs extending on each side of said lower housing and with said cavitation plates received within said channel until said forward end of said sleeve engages said leading edge of said lower housing to thereby prevent rearward movement of said guard;

means for closing said open rearward ends of said channel and thereby prevent forward movement of said sleeve, said means including a latch pivotal about a horizontal axis connected to said sleeve and fastening means releasably extending through said latch and said sleeve to secure said latch to said sleeve, a propeller shield having open inlet and outlet ends and being attached to said sleeve for encircling said propeller and thereby protecting said propeller from contact with foreign objects.

11. The guard of claim 10 further comprising a frame member extending downwardly from the forward end of said sleeve and engaging said leading edge of said lower housing substantially along the length thereof and a plurality of longitudinally disposed ribs extending between said frame member and said shield to further protect said propeller from contact with foreign objects.

12. The structure of claim 10 wherein each of said rearwardly extending legs include a latch hinged about a horizontal axis leaving an open space between said legs for said lower housing and cavitation plate to pass.

13. In combination with a motorboat including a motor, a propeller operatively connected to said motor, a lower housing with opposite leading and trailing edges and terminating in a vertically disposed skeg, said propeller being mounted on said lower housing adjacent said trailing edge and above said skeg, and a pair of horizontally disposed cavitation plates having forward and rearward ends extending laterally from said lower housing and above said propeller, a propeller guard comprising:

a rigid U-shaped sleeve having a forward end and opposite rearwardly extending legs and an elongated U-shaped channel formed therein, said channel having a closed forward end and open rearward ends which extend at least to the rearward ends of said cavitation plates, said open rear ends of said channels having an effective width therebetween substantially equal to the maximum combined width of said pair of cavitation plates whereby said sleeve is adapted to slide rearwardly into position with said legs extending on each side of said lower housing and with said cavitation plates received within said channel until said forward end of said sleeve engages said leading edge of said lower housing to thereby prevent rearward movement of said guard;

means for closing said open rearward ends of said channel and thereby prevent forward movement of said sleeve;

a propeller shield having open inlet and outlet ends and being attached to said sleeve for encircling said propeller and thereby protecting said propeller from contact with foreign objects, and a gridwork releasably mounted over said outlet end of said shield to further protect said propeller from contact with foreign objects, a hinge means for pivotally connecting said gridwork to said shield, said hinge positioned at the bottom of said shield and gridwork for pivoting said gridwork from a closed upstanding vertical position, rearwardly and downwardly.

* * * * *